US011213862B2

(12) United States Patent
De Caria

(10) Patent No.: US 11,213,862 B2
(45) Date of Patent: Jan. 4, 2022

(54) APPARATUS FOR FUNCTIONALLY REGENERATING A BRUSH FOR WASHING A FLEXOGRAPHIC PLATE

(71) Applicant: Sasu Vianord Engineering, Carros (FR)

(72) Inventor: Riccardo De Caria, Basiglio (IT)

(73) Assignee: SASU VIANORD ENGINEERING, Carros (FR)

( * ) Notice: Subject to any disclaimer, the term of this patent is extended or adjusted under 35 U.S.C. 154(b) by 0 days.

(21) Appl. No.: 16/800,131

(22) Filed: Feb. 25, 2020

(65) Prior Publication Data

US 2020/0269286 A1 Aug. 27, 2020

(30) Foreign Application Priority Data

Feb. 25, 2019 (EP) ..... 19159149

(51) Int. Cl.

| | |
|---|---|
| ***B08B 1/00*** | (2006.01) |
| ***B08B 1/02*** | (2006.01) |
| ***B08B 5/04*** | (2006.01) |
| ***B41F 35/00*** | (2006.01) |

(52) U.S. Cl.

CPC ..... *B08B 1/005* (2013.01); *B08B 1/02* (2013.01); *B08B 5/043* (2013.01); *B41F 35/001* (2013.01); *B08B 2220/04* (2013.01)

(58) Field of Classification Search

CPC ..... B41F 35/00; B41F 35/001

See application file for complete search history.

(56) References Cited

FOREIGN PATENT DOCUMENTS

| | | | |
|---|---|---|---|
| CN | 107772777 A | * | 3/2018 |
| EP | 3459740 A1 | | 3/2019 |
| WO | 2013156942 A1 | | 10/2013 |

OTHER PUBLICATIONS

Translation of CN107772777A by Lyu Zhixuan, published Mar. 9, 2018.*

* cited by examiner

*Primary Examiner* — Mikhail Kornakov
*Assistant Examiner* — Ryan L Coleman
(74) *Attorney, Agent, or Firm* — Stetina Brunda Garred and Brucker

(57) ABSTRACT

The invention relates to a cleaning apparatus (10) for functionally regenerating a brush (20) which can be used for washing a flexographic plate; in particular, the apparatus is configured to regenerate a brush (20) comprising a cylindrical core (5) about which a channel (4) supporting filaments (3) is fixed according to a spiral shape. The apparatus comprises a frame defining a rotation axis (100) for the brush and a motorized assembly, which can be operatively connected to an end of said cylindrical core (5) of the brush (20) to rotate it about the rotation axis (100). The apparatus (10) further comprises a cleaning unit (30) comprising a carriage (31), movable along a rectilinear guide (32) and a tool (33) provided with an end (33A) adapted to penetrate into the spaces defined between the turns of the spiral to detach the polymer and monomer residues hardened in said spaces as a result of the use of said brush for said washing.

17 Claims, 3 Drawing Sheets

APPARATUS FOR FUNCTIONALLY REGENERATING A BRUSH FOR WASHING A FLEXOGRAPHIC PLATE

CROSS REFERENCE TO RELATED APPLICATION(S)

The present application claims priority to European Patent Application No. 19159149.4 filed Feb. 25, 2019, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to the field of constructing systems for preparing digital printing plates for flexography. In particular, the present invention relates to an apparatus for functionally regenerating a brush for washing a flexographic plate. The present invention further relates to a method for regenerating a washing brush.

BACKGROUND ART

Flexography is a direct rotary printing method used, for example for making paper and plastic bags, milk cartons, disposable cups and the like. Flexography is used also for printing newspapers, envelopes, labels, films and acetate sheets, parcel paper and for many product packaging materials.

Flexography employs plates in relief made of photo-polymeric materials. The plates are flexible and soft, hence the name flexography. Such plates are inked and the print is obtained by means of direct deposition of the ink on the medium to be printed by virtue of a slight pressure applied by a printing cylinder on which the plates are positioned.

"Digital flexography" is a particular type of flexographic printing in which digital plates are used. In such plates, the photo-polymer is originally coated with a surface layer of material which prevents photo-exposure, such as for example a carbon or graphite layer. Such a layer of material is etched so as to create the negative image of the print subject. The step of etching is usually performed by means of a digital laser, controlled by a computer (hence the acronym CTP "Computer To Plate" used to indicate this step of the pre-printing process in the field). The plate is then photo-exposed to UV rays so as to cure the concerned part (i.e. the laser-engraved part). The material not exposed to light is eliminated by means of a step of washing actuated at a washing station, known in the field as a "developer". As a result of the washing, the plate will have a raised portion, which will then be used to transfer the printing ink onto the substrate (paper, plastic, etc.).

The plate is typically washed using solvent-based liquid which dissolves the polymer or monomer. Alternatively, the washing liquid also may be water-based. The use of washing solvent or liquid depends on the nature of the flexographic plate used. In all cases, the washing operation envisages the use of brushes which apply a mechanical action on the surface of the plate to promote the detachment of the monomer or of the polymer previously not exposed to light.

Typically, washing stations equipped with a chamber are used for washing the flat plates, inside which a movement plane is defined, along which the plate is advanced. The washing brushes act on the surface of the plate opposite to that resting on the movement plane. Hydraulic terminals which carry the liquid to the washing brushes are placed inside the chamber. An example of a washing chamber operating according to this principle is shown in patent EP2839345 in the mane of the Applicant.

In some washing stations, the plate to be washed is mounted on a supporting cylinder which is rotated, by means of a motor, inside a chamber in which the washing brushes are placed, which brushes are also driven to rotate about an axis parallel to that on which the supporting cylinder rotates. An example of this type of washing station is shown in application EP17192885.6 in the name of the Applicant.

With reference to Figures from 1 to 4, in almost all cases, the brushes used for washing flexographic plates are formed by a spiral of filaments (3) tightened by a channel (4) made of metal. The latter is fixed, e.g. by means of screws, to a cylindrical support (5) (also referred to as a core) which will be supported at its ends (5A) inside the washing chamber in a position close to the movement plane (or to the supporting cylinder) of the plate (L) (see FIG. 4).

As mentioned above, the channel (4) is fixed so as to develop as a spiral about the supporting cylinder (5). The filaments of the brush may be of vegetable, animal or artificial origin (e.g. nylon). The size of the filament (diameter, length, etc.) determines the hardness of the brush, while the pitch of the spiral determines the density. Instead, the core which supports the spiral may be made of metal or plastic material.

Given their structure, the washing brushes have a potentially quite long duration. However, despite the lubricating effect of the solvent or of the water-based solution, the monomer or polymer (M-P) tends to deposit and then hardens in the spaces (7) defined between the turns of the channel (4) (see FIG. 4). Therefore, after a given period, the brushes are contaminated by the hardened plastic material and therefore very ineffective.

Currently, the only remedy for this condition is to replace the brushes with other new ones. However, this solution unfavorably impacts on the costs of the cleaning station and, more in general, on the process costs linked to the production of flexographic plates.

So, it is a main task of the present invention to provide an apparatus and a method which allow solving this drawback. More precisely, it is a first object of the present invention to provide an apparatus and method for functionally regenerating a brush for washing a flexographic plate in order to avoid, or at least delay, the replacement thereof with a new one. It is a further object of the present invention to provide an apparatus and method for regenerating a washing brush which is reliable and easy to manufacture at highly competitive costs.

SUMMARY

Therefore, the present invention relates to a cleaning apparatus for functionally regenerating a brush which can be used for washing a flexographic plate. In particular, the apparatus is configured to regenerate a brush comprising a cylindrical core about which a channel supporting filaments is fixed according to a spiral shape, which filaments implement the mechanical washing action on the flexographic plate.

The apparatus according to the invention is characterized in that it comprises:

a frame with at least two supports adapted to define a rotation axis for the brush;

a motorized assembly, which can be operatively connected to an end of said cylindrical core of said brush to rotate it about said rotation axis;

a cleaning unit comprising a carriage, movable along a rectilinear guide and a tool provided with an end adapted to penetrate into the spaces defined between the turns of said spiral to detach the polymer and monomer residues hardened as a result of the use of said brush for said washing.

In particular, the guide is configured so as to force the carriage to move, due to the spiral shape of the channel, along a rectilinear advancement direction substantially parallel to the rotation axis of the brush.

Advantageously, the rotation of the brush combined with the advancement imparted by the spiral shape of the channel allows an effective detachment of the plastic material residues. The elimination of such residues allows restoring the function of the brush, which can thus be reused for the washing operation.

According to a possible embodiment, the apparatus may comprise suction means for aspirating the monomer-polymer residues detached as a result of the scraping action of the tool. Preferably, the suction means comprise a suction tube, comprising a suction mouth, and a discharge section communicating with a container for collecting said polymer or monomer residues.

According to a preferred embodiment, the end of said tool is tapered so as to increase the scraping action brought upon the polymer or monomer residues.

In an embodiment, the motorized assembly comprises a motor which either directly or indirectly actuates a chuck provided with a self-locking collet adapted to grip an end of the core of said brush. Preferably, the motor drives a gear motor which, in turn, rotates the rotatable chuck in both possible directions of rotation.

In accordance with a preferred embodiment, the motor assembly comprises friction means operatively interposed between the motor and the chuck to transmit the torque generated by the motor in a gradual manner to the chuck.

In an embodiment, the apparatus comprises a self-aligning bearing to support an end of said cylindrical core opposite to an end intended to be operatively connected to the motor assembly.

LIST OF THE DRAWINGS

Further features and advantages of the present invention will be more apparent from the following detailed description provided by way of non-limiting example and illustrated in the accompanying figures, in which.

The same reference numbers and letters in the figures refer to the same elements or components.

DETAILED DESCRIPTION

With reference to the aforesaid figures, the present invention thus relates to a cleaning apparatus 10 for functionally regenerating a washing brush of a flexographic plate. For the purposes of the present invention, the term regenerating indicates a cleaning operation of the brush which leads to the elimination of the monomer or polymer which accumulates between the filaments of the brush. The aim is to restore the function of the brush, i.e. to be able to use still use it effectively for the washing operation.

Figure 1:
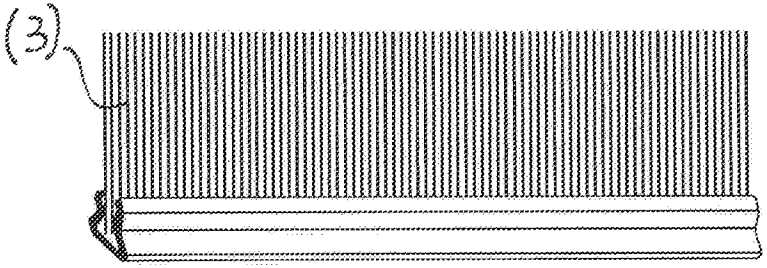
FIG. 1 is a view of a portion of a component of a brush for washing a flexographic plate.
Figure 2:
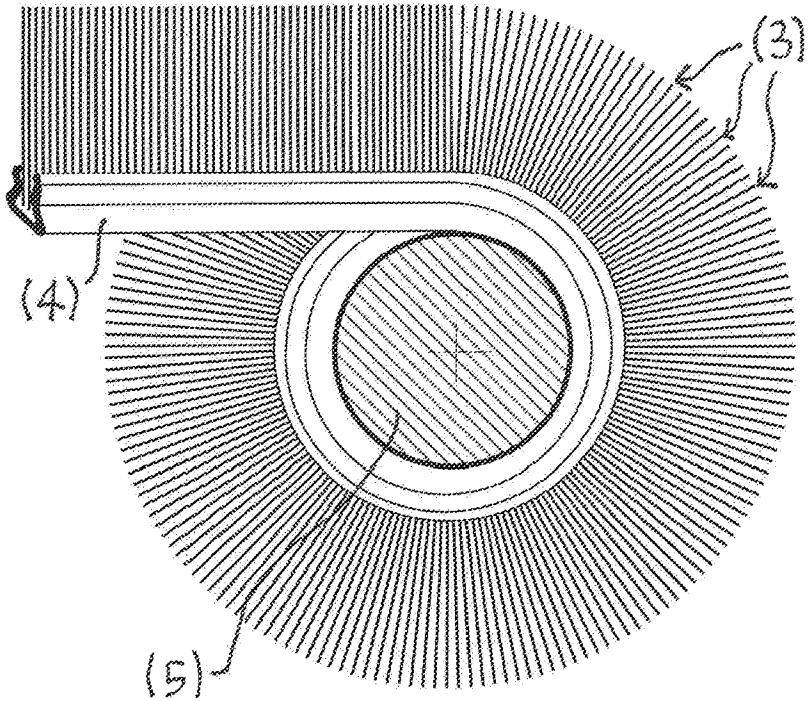
FIGS. 2 and 3 are partial views of a brush for washing a flexographic plate comprising a supporting cylinder about which the component of FIG. 1 is wound as a spiral.
Figure 3:
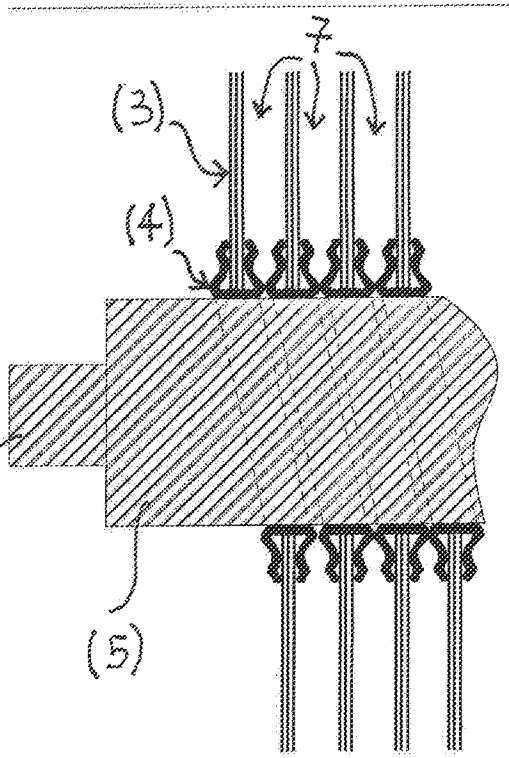
Figure 4:
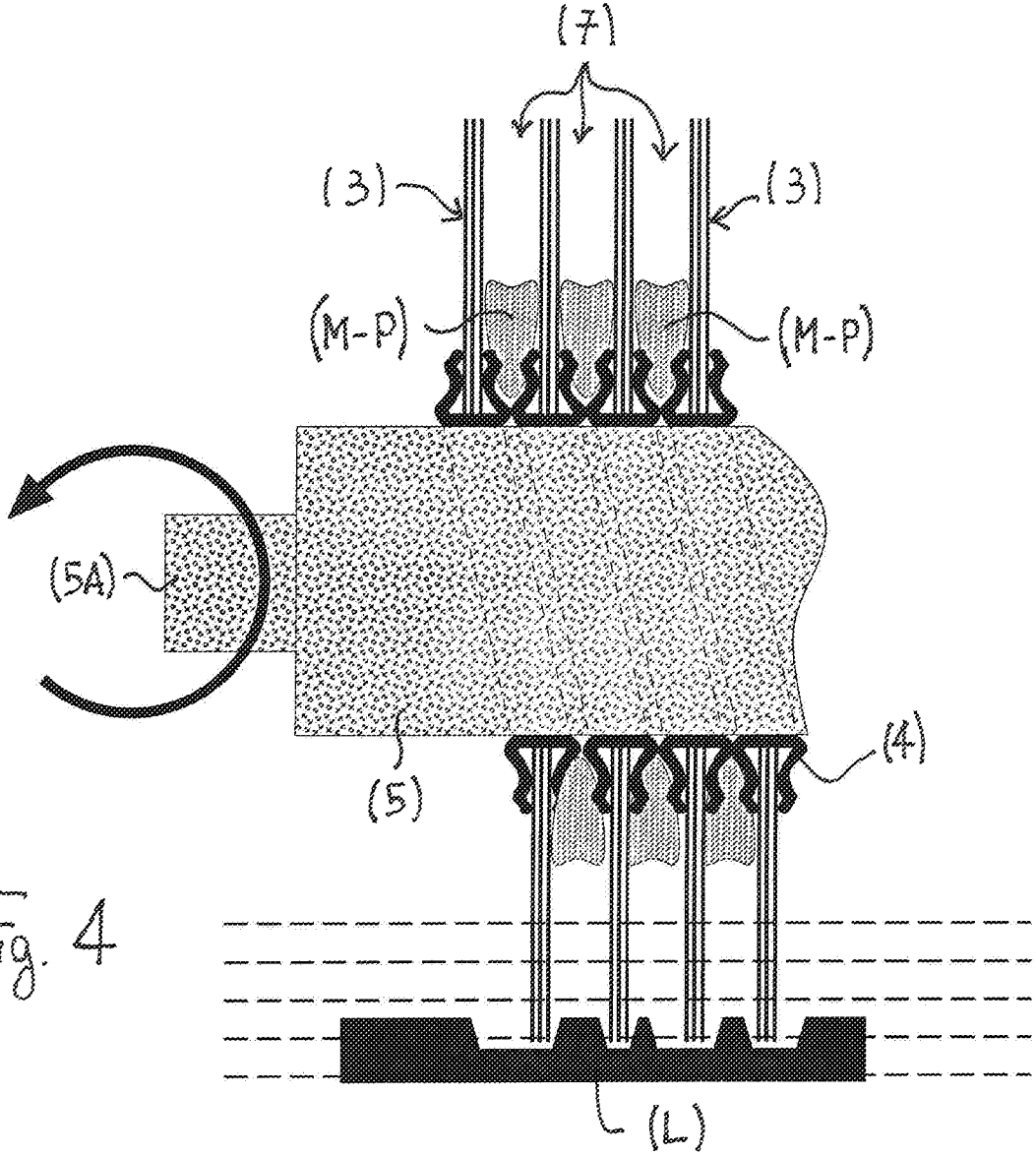
FIG. 4 is a partial view of a brush for washing a flexographic plate in a condition of non-use determined by the accumulation of monomer or polymer in the spaces defined between the turns of the component wound as a spiral about the cylindrical support of FIG. 1.
Figure 5:
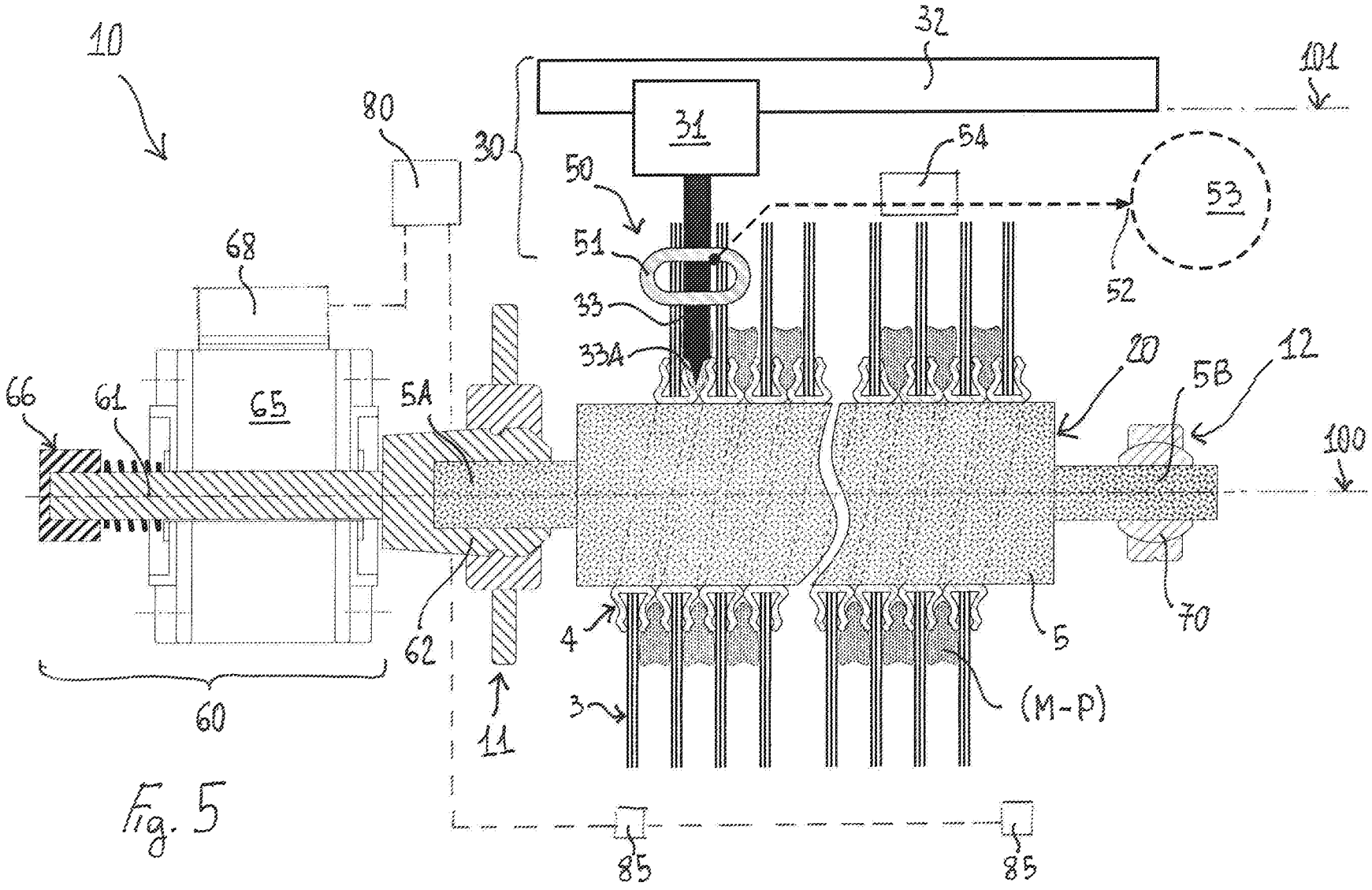
FIG. 5 shows a diagrammatic view of a different embodiment of the apparatus according to the present invention.

The apparatus 10 according to the invention is intended for cleaning a brush 20 having the structure described above with reference to Figures from 1 to 3, i.e. comprising a cylindrical core 5 (or cylindrical support 5) about which a channel 4, to which the filaments 3 are fixed according to a spiral configuration. With reference to FIG. 5, the cylindrical support 5 comprises two opposite ends 5A, 5B. The latter allow the positioning of the brush 20 inside a washing station. In particular, in order to allow the rotation of the brush 20, and therefore the washing operation, one of the two ends 5A, 5B can be connected either directly or indirectly to a motor member. As a result of its rotation, the filaments 3 of the brush 20 apply a mechanical action onto the surface of the plate which determines, also for the presence of the washing liquid (solvent or water-based solution) the removal of the previously not photo-exposed monomer or polymer.

With reference again to FIG. 5, the cleaning apparatus 10 comprises a frame comprising at least two supports 11, 12, each of which is intended to sustain, either directly or indirectly, one of the two ends 5A, 5B of the cylindrical core 5 of the brush 20. In particular, the two supports 11,12 define a rotation axis 100 for the brush 20 which coincides with the longitudinal axis about which the cylindrical core 5 develops.

The apparatus 10 further comprises a motorized assembly 60, which is operatively connected to one of the two ends 5A, 5*b* in order to rotate the brush 20 about the rotation axis 100 in controlled manner. The apparatus 10 also comprises a cleaning unit 30 comprising a carriage 31 movable along a guide 32. The carriage 31 is integral with at least one tool 33 provided with an end 33*a* adapted to penetrate into the spaces 7 defined between the turns of the channel 4 of the brush 20.

The guide 32 is configured so as to force the carriage 31 to move along an advancement direction 101 substantially parallel to the rotation axis 100 of the brush 20. In this regard, as will be better described below, as a result of the rotation of the brush 20, determined by the motorized assembly 60, the tool 33 and therefore the carriage 31 translate along the advancement direction 101 due to the helical configuration of the brush itself. The guide 32 has the purpose of maintaining such a translation parallel to the rotation axis 100 of the brush 20 and at the same time to prevent the carriage 31 and the tool 33 from being fed in rotation about the brush 20. The assembly formed by the guide 32 and the carriage 31 constrain the tool 33 so that it always maintains the same radial position with respect to the rotation axis 100. Due to this condition, advancing along the movement direction 101, the end 33A of the tool 33 mechanically acts on monomer-polymer residues present between the turns, whereby removing them from the spaces 7 in which they hardened.

According to a preferred embodiment of the invention, the apparatus 10 may comprise suction means 50 for aspirating the monomer-polymer residues detached as a result of the scraping action of the tool 33. Preferably, such suction means 50 comprise an extractor fan 54, a suction tube, comprising a suction section or mouth 51 and a discharge section 52 communicating with a collection container 53 of the polymer or monomer. The suction section 51 is arranged near the tool 33 so as to aspirate the monomer-polymer residues immediately after their detachment. The extractor fan 54 is configured so as to create a vacuum sufficient to allow effective suction.

Again, in agreement with a possible preferred embodiment, the apparatus 10 may comprise a driving unit (not shown) operatively connected to the suction mouth 51 to move it along a direction parallel to the rotation axis 100 of the brush 20. This movement unit may allow the suction mouth 51 to remain in a position close to the tool 33 during the advancement of the latter along the movement direction 101.

The movement unit may be completely independent from the carriage 31 which is integral with the tool 33. However, in a possible variant, the driving unit may be formed by the carriage 31 itself. In particular, the carriage 31 may move the suction mouth 51 together with the tool 33.

In accordance with a preferred embodiment, the end 33A of the tool 33 is pointed or however tapered. This in order to confer a greater penetration capability into the polymer or monomer (M-P) hardened between the turns of the brush 20. At the same time, this makes the scraping action of the tool 33 more effective. With reference to the material, the tool can be made of metal or in any case of any material of sufficient hardness and resistance to scrape and remove hardened polymer or monomer residues.

Moreover, in a possible embodiment, the apparatus 10 may also comprise adjusting means configured to allow adjusting the position of the tool 33, in particular of its scraping end 33A, with respect to the rotation axis 100 of the brush 20. Through such means, it is possible to vary the penetration depth of the scraping end 33A. In this manner, the removal of the polymer-monomer residues may occur in different "passes" or "cycles", as described in greater detail hereinafter.

In a first possible embodiment, the adjustment means may allow the adjustment of the position of the tool 33 with respect to the carriage 31. Alternatively, the adjustment means may allow adjusting the position of the guide 32 with respect to the rotation axis 100 of the brush 20. In other words, the position of the tool 33 may be adjusted by maintaining fixed the radial position of the carriage 31 and the guide 32 or alternatively by varying the position of the entire assembly formed by guide 32, carriage 31 and tool 33 with respect to the rotation axis 100 of the brush.

Again, with reference to FIG. 5, according to a preferred embodiment, the motorized assembly 60 comprises a motor 68, which either directly or indirectly actuates a chuck 61 provided with a self-locking collet 62 adapted to grip an end (5A in FIG. 5) of the core 5 of the brush 20. In a possible embodiment, the motor 68 actuates a gear motor 65, which in turn causes the rotation of the chuck 61. The motor 68 is configured so as to allow the rotation of the chuck 61 in both directions. The choice of the rotation direction of the chuck 61 determines the advancement direction of the carriage 21 and of the tool 33 along the movement direction 101.

Again, in accordance with a preferred embodiment of the invention, the motor assembly 60 also comprises friction means 66 operatively interposed between the gear motor 65 and the chuck 61 in order to allow a gradual transmission of the torque to the chuck itself. The use of the friction means 66 allows managing more fluidly the initial step of the cleaning operation in which the tool 33 tends to "catch" on the hardened monomer or polymer. In general, the clutch means 66 allow the motor 68 to react to the variations of load to which the chuck 21 is subjected due to the action of the tool 33 on the brush 20.

In accordance with a possible embodiment, the apparatus 10 comprises a self-aligning bearing 70, at the second support 12, to support the end 5B of the supporting cylinder 5 opposite to the end 5A gripped by self-locking collet 62. The use of a self-aligning bearing 70 facilitates the positioning of the brush 20 to be cleaned and at the same time follows possible oscillations thereof during the cleaning operations.

The apparatus 10 according to the invention comprises a control unit 80 operatively connected at least to the motor assembly 60 for controlling its actuation. The control unit 80 is preferably also connected to the suction means 50 and possibly also to the means for adjusting the position of the tool and/or to the means for moving the suction mouth 51, if these are actually provided. The apparatus 10 may also comprise sensors 85 for detecting the position reached by the tool 33 and/or the position of the suction mouth 51 along the advancement direction 101.

From an operational point of view, the functional regeneration of the brush 20 takes place in the manner described below. The brush 20 is removed from the washing station and positioned in the apparatus 10, whereby locking the cylindrical core 5 of the brush 20 between the self-locking collet 20 and the self-aligning bearing 70.

At this point, the position of the tool 33 is adjusted so that the end 33A fits into the space 7 between the two first turns of the channel 4 which carries the filaments 3 of the brush 20. The motor 68 is operated by means of the control unit 90 so as to determine the rotation of the chuck in a first predetermined direction. At the same time, the suction means are also enabled after positioning the suction mouth 51 near the tool 33.

Due to the rotation of the chuck, the end 33A of the tool 33 detaches the hardened polymer-monomer between the turns of the channel 4. The spiral-like development determines an advancement in the longitudinal direction (direction 101) of the tool 33. Such an advancement is bound by the rectilinear guide 32 which keeps the tool 33 at the same radial distance from the rotation axis 100 of the brush 20. The chuck 61 is stopped when the tool 33 has completed the entire path between the turns of the channel 4.

At this point, by means of the control unit 90, the chuck 61 can be rotated in a direction opposite to the previous one to determine a longitudinal advancement of the tool 33 in a direction opposite to the previous one. By reversing the rotation direction of the chuck 61, it is therefore possible to perform a series of cleaning cycles of the brush 20, wherein each cycle is represented by a stroke of the tool 33 along the advancement direction 101 between the two ends of the spiral.

The operation of the apparatus 10 according to the invention can be semiautomatic or automatic. In a semi-automatic configuration, the operator will actuate the motor 68 by setting the rotation direction of the chuck 61. On the contrary, in an automatic configuration, the operator can program the control unit 80 so as to achieve a number of predetermined strokes of the tool 33 in the two directions. The control unit 80 will actuate the motor 68 on the basis of the parameters set by the operator. In this automatic configuration, the apparatus 10 may comprise sensors 85 for detecting the position reached by the tool along the movement direction 101. On the basis of the signal provided by them, the control unit 80 can lock or set the rotation direction of the brush 20 and therefore the advancement direction of the tool 33.

Alternatively, the control unit 80 can implement the series of cleaning cycles on the basis of the characteristics of the brush preset by the operator (length and diameter of the core 5, the pitch of the spiral). The control unit 80 could, for example, calculate the number of rotations required to complete a cleaning cycle of the entire spiral and reverse the rotation direction of the brush when such a number of rotations is reached.

The present invention therefore also relates to a method for functionally regenerating a brush for cleaning a flexographic plate. In particular, such a method applies to a brush formed by a core 5, or cylindrical support 5 about which a channel 4 supporting the filaments 3 is fixed according to a spiral configuration. In particular, the method according to the invention also comprises the steps of:

connecting the brush to a motorized assembly adapted to rotate it about a rotation axis coinciding with the longitudinal axis of the brush itself;

preparing a tool for removing the hardened polymer-monomer residues from between the turns of the brush by forcing said tool to move in a direction parallel to the rotation axis of said brush;

positioning said tool so that a scraping end thereof fits between the turns of the spiral defined by said channel about the core of said brush;

rotating said brush, by means of said motorized assembly, about said rotation axis so that the rotation of the brush determines an advancement of the tool along the advancement direction due to the spiral shape of said channel.

The method according to the invention is advantageously and easily implemented by means of the apparatus described above. In particular, the carriage 31 and the guide 32 force the tool 33 to move along a movement direction 101 parallel to the rotation axis 100 of the brush 20. At the same time, the carriage-guide assembly keeps the scraping end of the tool at a predetermined distance from the rotation axis.

In a preferred embodiment, the method according to the invention envisages rotating the brush in a first predetermined rotation direction so that the tool can complete a first cleaning cycle advancing in a first direction along the advancement direction. The method further comprises the step of reversing the rotation direction of the brush at the end of said first cleaning cycle so as to implement a second cleaning cycle in which the tool advances in a second direction opposite to said first direction. In this regard, the first cycle is considered completed when the tool has traveled for the entire length of the spiral formed by the channel about the cylindrical support.

The described technical solutions allow to fully achieve the predetermined tasks and objects. In detail, the apparatus according to the invention is highly effective, reliable and easy to manufacture at competitive costs. The functional regeneration of the brush allows a considerable saving in terms of process costs.

The invention claimed is:

1. A cleaning apparatus (10) for functionally regenerating a brush (20) which can be used to wash a flexographic plate, said brush (20) comprising a cylindrical core (5) about which a channel (4) supporting filaments (3) is fixed according to a spiral shape, wherein the cleaning apparatus comprises:

a frame comprising at least two supports (11, 12) adapted to define a rotation axis (100) for said brush (20);

a motorized assembly (60), which can be operatively connected to an end of said cylindrical core (5) of said brush (20) to rotate it about said rotation axis (100);

a cleaning unit (30) comprising a carriage (31), movable along a rectilinear guide (32) and a tool (33) provided with an end (33A) adapted to penetrate into spaces defined between turns of said spiral to detach polymer and/or monomer residues, wherein the polymer and/or monomer residues were hardened in said spaces as a result of use of said brush for washing, and wherein said guide (32) is configured so as to force said carriage (31) to move, due to the spiral shape of said channel (4) and as a result of the rotation of said brush (20), along an advancement direction (101) substantially parallel to said rotation axis (100) of said brush (20).

2. An apparatus (10) according to claim 1, wherein said apparatus (10) comprises suction means (50) for aspirating the polymer and/or monomer residues detached as a result of the tool (33).

3. An apparatus (10) according to claim 2, wherein said suction means (50) comprise an extractor fan (54), a suction tube comprising a suction mouth (51) and discharge section (52) communicating with a collection container (53) of said polymer and/or monomer residues.

4. An apparatus (10) according to claim 3, wherein said suction mouth (51) is configured to move it along a direction (101) parallel to said rotation axis (100) of said brush (20) so as to keep said suction mouth (51) in a position adjacent to that of said tool (33) during the advancement of the latter along the advancement direction (101).

5. An apparatus (10) according to claim 1, wherein said end (33A) of said tool (33) is tapered.

6. An apparatus (10) according to claim 1, wherein said apparatus (10) is configured such that a position of said tool (33) with respect to said rotation axis (100) of said brush (20) can be adjusted.

7. An apparatus (10) according to claim 1, wherein said motorized assembly (60) comprises a motor (68) which either directly or indirectly actuates a chuck (61) provided with a self-locking collet (62) adapted to grip one end of the core (5) of said brush (20).

8. An apparatus (10) according to claim 7, wherein said motor (68) actuates a gear motor (65), which in turn causes the rotation of said chuck (61), said chuck (61) being rotatable in both possible directions of rotation.

9. An apparatus (10) according to claim 7, wherein said motor assembly (60) comprises friction means (66) operatively interposed between said motor (68) and said chuck (61) to transmit the torque generated by said motor (68) in a gradual manner to said chuck (61).

10. An apparatus (10) according to claim 8, wherein said motor assembly (60) comprises friction means (66) operatively interposed between said motor (68) and said chuck (61) to transmit the torque generated by said motor (68) in a gradual manner to said chuck (61).

11. An apparatus (10) according to claim 1, wherein said apparatus (10) comprises a self-aligning bearing (70) to support an end (5B) of said cylindrical core (5) opposite to an end (5A) intended to be operatively connected to said motor assembly (60).

12. An apparatus (10) according to claim 1, wherein said apparatus (10) comprises a control unit (80) operatively connected at least to said motor assembly (60) to control the actuation thereof.

13. An apparatus (10) according to claim 3, wherein said apparatus (10) comprises a control unit (80) operatively connected at least to said motor assembly(60) to control activation and deactivation therefor, and wherein said control unit (80) is operatively connected to said suction means (50) to control the activation and deactivation thereof.

14. An apparatus (10) according to claim 12, wherein said apparatus (10) comprises sensors (85) to detect the position of said tool (33) and wherein said control unit (80) is electrically connected to said sensors (10) to receive from them a signal characteristic of the position reached by said tool (33).

15. An apparatus (10) according to claim 13, wherein said apparatus (10) comprises sensors (85) to detect the position of said tool (33) and wherein said control unit (80) is electrically connected to said sensors (10) to receive from them a signal characteristic of the position reached by said tool (33).

16. A method for functionally regenerating a brush (20) for cleaning a flexographic plate, wherein said brush comprises a cylindrical core (5) about which a channel (4) supporting filaments (3) is fixed according to a spiral shape, characterized in that the method comprises the steps of:

A. connecting the brush to a motorized assembly adapted to rotate it about a rotation axis coinciding with a longitudinal axis of the brush itself;

B. preparing a tool for removing hardened polymer and/or monomer residues, wherein the brush is configured to move in an advancement direction parallel to the rotation axis of said brush, and wherein the hardened polymer and/or monomer residues are located between turns of said spiral;

C. positioning said tool so that a scraping end thereof fits between the turns of the spiral, wherein the spiral is defined by said channel about the core of said brush;

D. rotating said brush, by means of said motorized assembly, about said rotation axis so that the rotation of the brush causes an advancement of the tool along the advancement direction due to the spiral defined by said channel.

17. A method according to claim 16, wherein in said step D, said brush is rotated in a first predetermined rotation direction so that said tool completes a first cleaning cycle by advancing in a first direction along the advancement direction and wherein said method comprises the step of E. reversing the rotation direction of said brush at an end of said first cleaning cycle so as to make a second cleaning cycle, wherein advancement of said tool takes places in a second direction opposite to said advancement direction.

* * * * *